US005329074A

United States Patent [19]

Alexander

[11] Patent Number: 5,329,074

[45] Date of Patent: Jul. 12, 1994

[54] MARINE ENGINE EXHAUST MUFFLER

[75] Inventor: John E. Alexander, Monroeville, Ind.

[73] Assignee: Porter, Incorporated, Decatur, Ind.

[21] Appl. No.: 72,146

[22] Filed: Jun. 4, 1993

[51] Int. Cl.[5] ..... F01N 7/00

[52] U.S. Cl. ..... 181/235; 181/238; 181/239; 181/240; 181/255; 181/269; 181/273; 181/250; 440/89

[58] Field of Search ..... 181/211, 235, 229, 232, 181/233, 238, 239, 240, 244, 246, 249, 250, 255, 260, 262, 269, 272, 273, 282; 440/89; 114/343

[56] References Cited

U.S. PATENT DOCUMENTS 4,744,778 5/1988 Porter ..... 181/235 X
4,786,265 11/1988 Porter ..... 181/235 X
4,977,977 12/1990 von Widmann et al. ..... 181/235

*Primary Examiner*—Michael L. Gellner
*Assistant Examiner*—Khanh Dang
*Attorney, Agent, or Firm*—Rankin, Hudak & Hill

[57] ABSTRACT

An exhaust muffler for mounting on the transom of a powerboat in association with the exhaust pipes which extend through the transom. The muffler comprises a housing extending laterally across the stern of the boat and rearwardly from the transom to define an interior space. The housing has a floor located below the water line; opposed end walls; a front wall located adjacent to the transom with openings formed therein, through which exhaust gas can pass from the exhaust pipes; a rear wall having exhaust ports formed therein and a cover that encloses the interior space. Located within the enclosed space are muffler inserts secured to the floor and also to the front and rear walls. Each insert has a domed portion defining a muffling chamber that communicates with the respective exhaust pipe, and a second domed chamber defining an expansion chamber that communicates with the respective exhaust port located in the rear wall of the housing. The muffling chamber and the expansion chamber are in communication with one another through a passage located below the water line and defined by a portion of the insert and by the floor of the muffling chamber. Accordingly, exhaust gas introduced into the muffling chamber is forced through the water filled passage into the expansion chamber and then exits through the respective exhaust port.

6 Claims, 5 Drawing Sheets

MARINE ENGINE EXHAUST MUFFLER

BACKGROUND OF THE INVENTION

This invention relates to an exhaust muffler for use on marine engines of the type found on inboard/outboard power boats, and specifically to an outboard exhaust muffler which is located outside the hull and aft of the transom.

Inboard/outboard type power boats typically have a plurality of exhaust pipes extending through the transom at the stern of the boat. These exhaust pipes are typically located slightly above the waterline. With larger marine engines, the exhaust noise emanating from the exhaust pipes can be substantial. Such exhaust noise is often disturbing to occupants of the power boat, to water skiers who are the following the boat, to other boaters and to nearby residents.

Many communities have established anti-noise ordinances which prohibit power boats producing levels of noise above certain decibel limits, particularly in connection with waterways that extend through residential communities. For these reasons and others, it is desirable to provide a muffler at the stern of the power boat to reduce the noise of engine exhaust.

Typical examples of prior art power boat mufflers intended for this purpose are shown in U.S. Pat. Nos. 4,744,778 and U.S. Pat. No. 4,786,265. These devices provide a combination swim platform and muffling device mounted at the stern of the boat. They generally include one or more vertical baffles extending down into the water that partially fills a muffling chamber. With this system, the pressure of the exhaust gases forces the gas below the water level and through to the other side of the baffle to another chamber from which the exhaust gas is discharged, usually through an exhaust outlet with an integral flapper valve.

The marine engine exhaust muffler of the present invention provides an improved construction over that described above and affords other features and advantages heretofore not obtainable.

SUMMARY OF THE INVENTION

The present invention provides an exhaust muffler for marine engines used in inboard/outboard type power boats wherein one or more exhaust pipes from the marine engine extend through the transom at the stern of the boat. The muffling device includes a housing extending laterally across the stern of the boat and rearwardly from the transom to define an interior space. The housing has a floor located below the waterline; opposed end walls; a front wall located adjacent the transom and having at least one opening formed therein through which exhaust gas can pass from the exhaust pipe; a rear wall having at least one exhaust port formed therein; and a cover that encloses the interior space. Because the chamber is located, at least in part, below the waterline, it is partially filled with water.

Located within the chamber is at least one muffler insert secured to the floor of the chamber and also to the front wall and the rear wall. The insert is preferably formed from a single layer of moldable material.

The insert has a domed portion that defines with the floor, an enclosed muffling chamber positioned to communicate with the exhaust pipe. Also, the insert has a second domed portion which defines an expansion chamber that communicates with the exhaust port located in the rearward wall of the housing.

The muffling chamber and the expansion chamber are in communication with one another through a passage located below the waterline and defined by a portion of the insert and by the floor of the muffling chamber. Accordingly, exhaust gas introduced into the muffling chamber is forced by the pressure of the gas through the water filled passage into the expansion chamber and then exits through the exhaust port.

Thus, the exhaust muffler of the present invention provides muffling capabilities superior to those provided by exhaust mufflers of the prior art due to its outboard location and unique shaping of the muffling chamber and expansion chamber between which the gas is transmitted through the water-filled passage that connects the two.

The shaping of the muffling chamber and expansion chamber is designed to avoid an increase in back-pressure which could have an adverse effect on engine performance. Also, with the construction so described, the housing for the muffler serves a dual purpose in that it is also used to provide an attractive swimming and diving platform extending aft from the transom at about or slightly above the waterline.

DESCRIPTION OF THE PREFERRED EMBODIMENT

Figure 1:
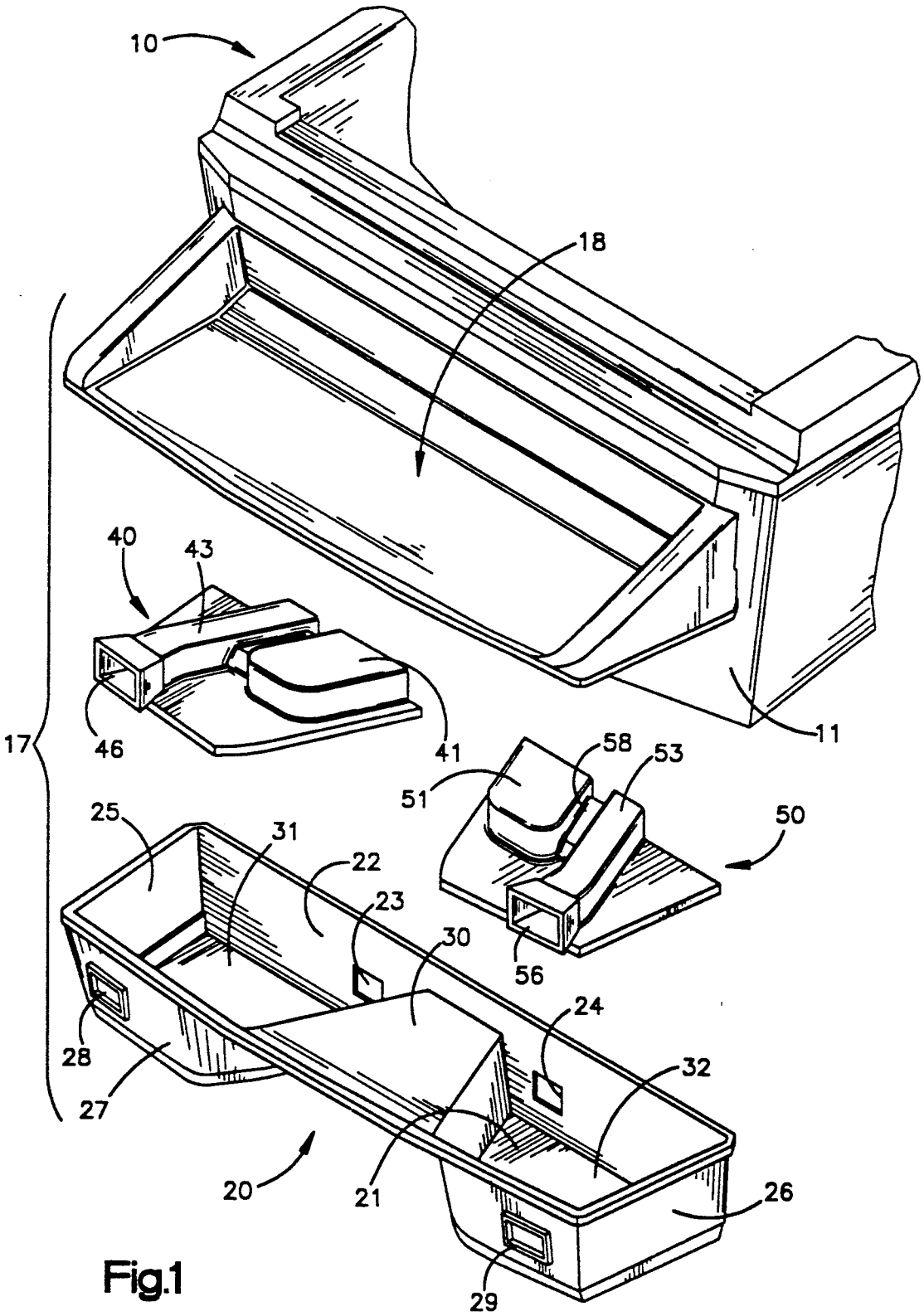
FIG. 1 is an exploded perspective view showing the stern portion of an inboard/outboard type power boat having an engine exhaust muffler embodying the invention.
Figure 2:
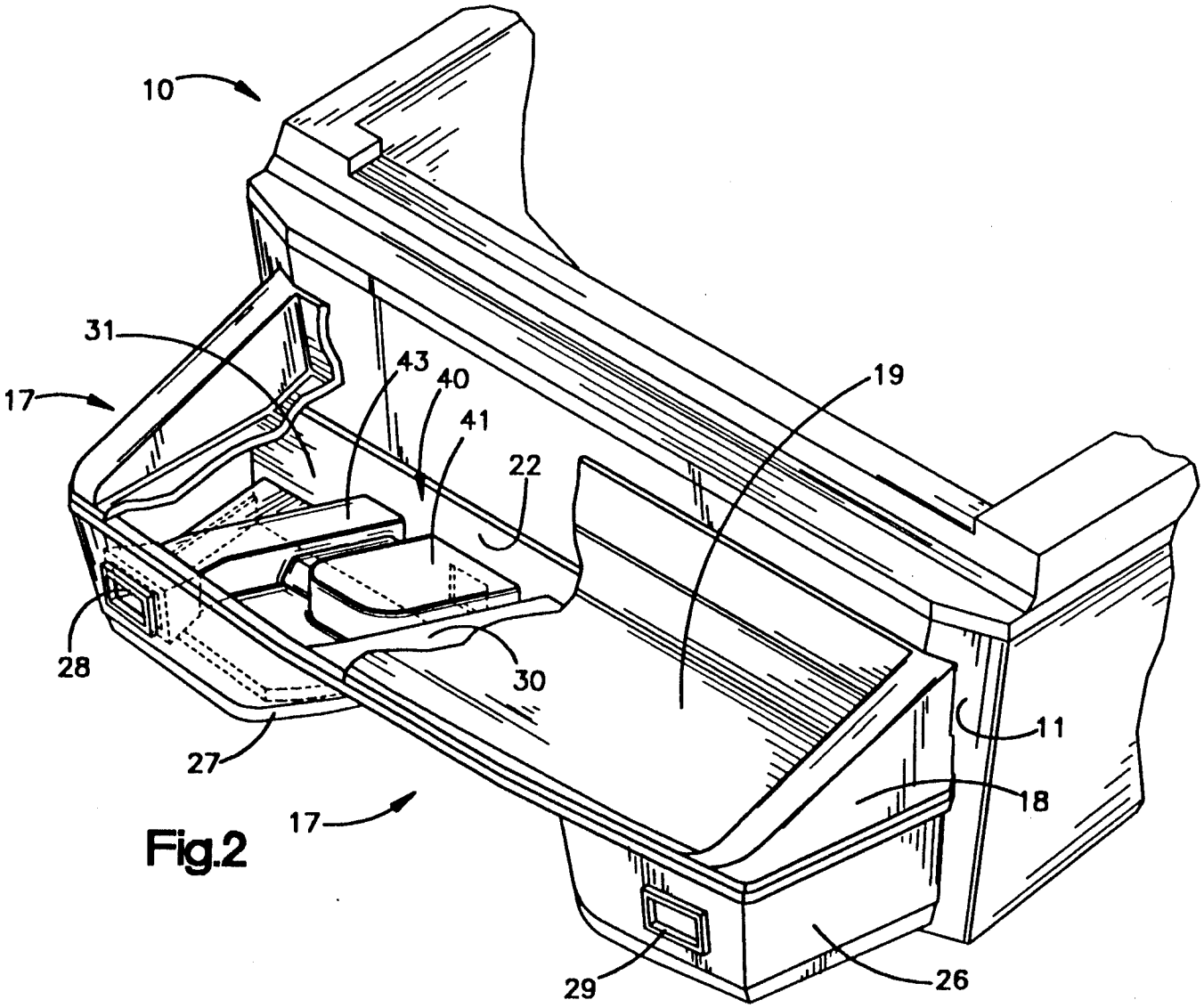
FIG. 2 is a perspective view showing the exhaust muffler in assembled condition with parts broken away and shown in section for the purpose of illustration.
Figure 3:
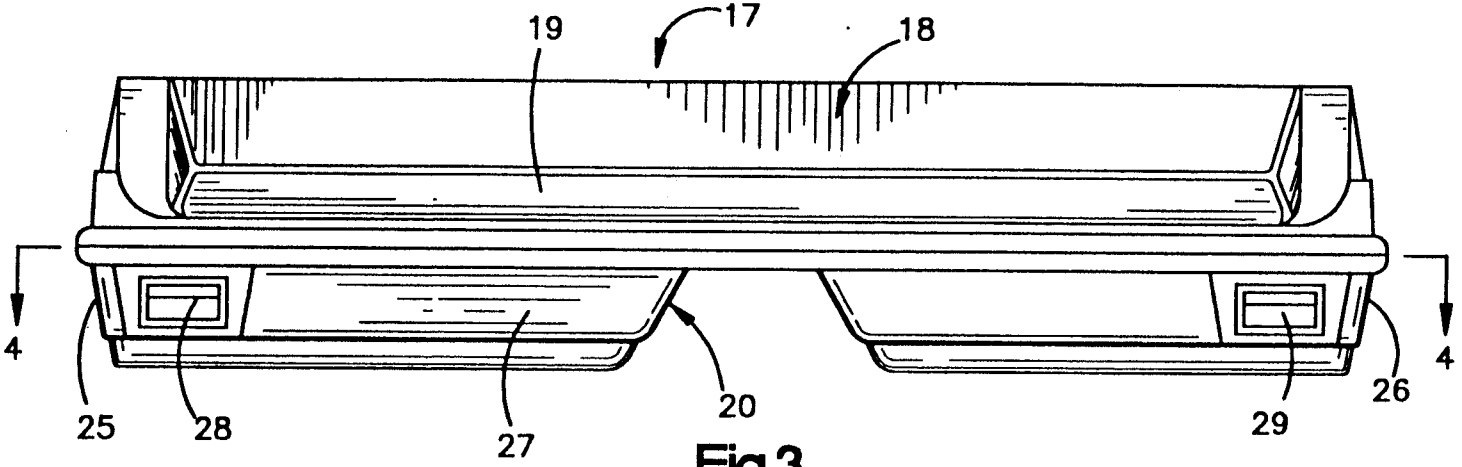
FIG. 3 is an end elevation of the marine engine muffler of the FIGS. 1 and 2.
Figure 4:
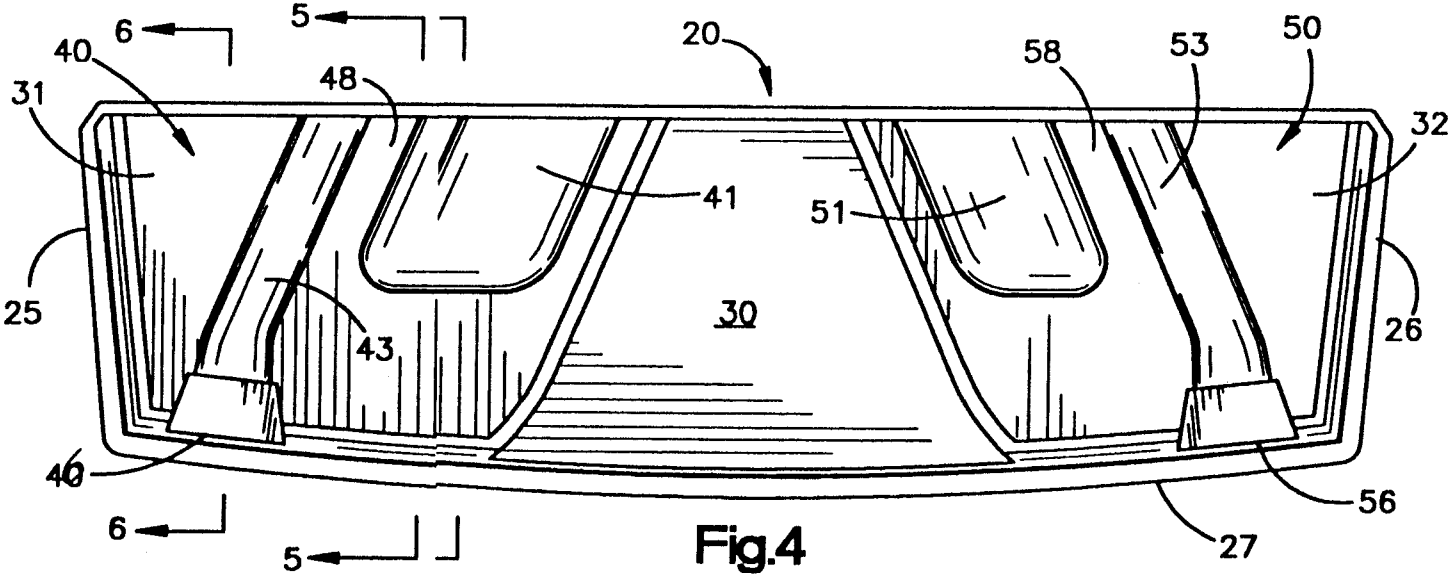
FIG. 4 is a sectional view taken on the line 4—4 of FIG. 3.
Figure 5:
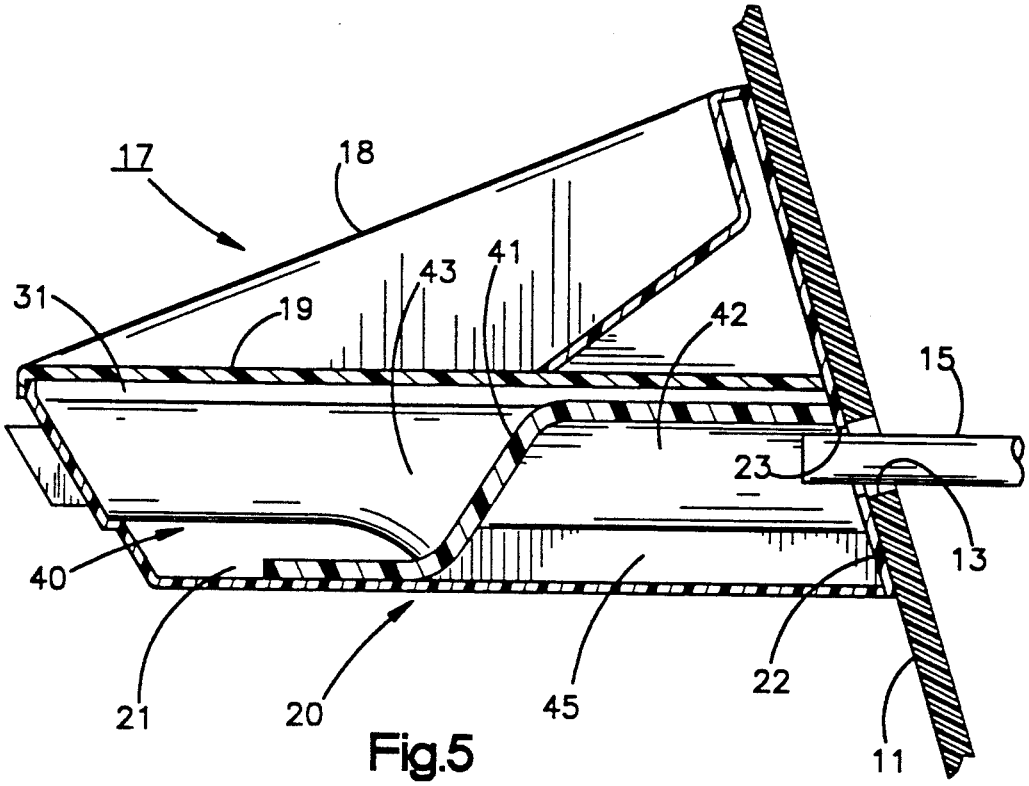
FIG. 5 is another sectional view on an enlarged scale taken on the line 5—5 of FIG. 4.
Figure 6:
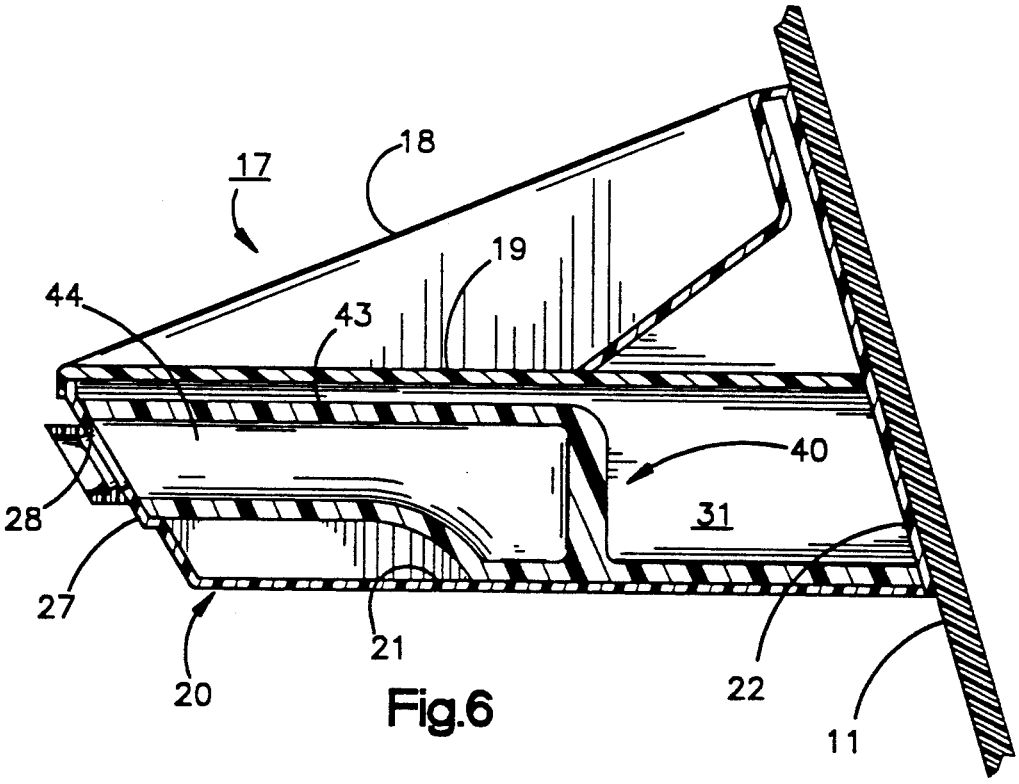
FIG. 6 is still another sectional view on an enlarged scale taken on the line 6—6 of FIG. 4.

Referring more particularly to the drawings and initially to FIG. 1, there is shown a power boat 10 of the type that uses an inboard/outboard marine engine, the power plant being internal and the propeller drive assembly being external and extending rearwardly of the transom 11. The engine itself is not shown and is not a part of the present invention.

In the embodiment shown, the transom has two exhaust ports 13 located therein. Each exhaust port provides an opening through which an exhaust pipe 15 extends. Each exhaust pipe extends into a muffler and swim platform assembly 17.

The muffler and swim platform assembly 17 includes a swim platform extension 18 that is formed integrally with the hull of the boat and which provides an upwardly facing surface 19 that provides a convenient platform for swimming and diving, particularly when the boat is at anchor.

The muffler and swim platform assembly 17 also includes a muffler housing 20 that is formed separately and which defines an upwardly facing open space therein. The housing 20 is attached both to the transom 11 and to the bottom surface of the platform extension 18 to provide an enclosed chamber. The floor 21 of the housing is located below the waterline.

The forward wall 22 of the housing has a pair of openings 23 and 24 formed therein and adapted to register with the ports 13 formed in the transom and through which the exhaust pipes 15 extend. The housing 20 also includes a pair of opposed end walls 25 and 26 perpendicular to the forward wall 22 and a contoured rear wall 27 comprising two sections that connect to the end walls 25 and 26 at their outer ends and which extend parallel to the forward wall for some distance and then curve inwardly until they intersect the forward wall 22 leaving an exposed surface portion in the transom.

The drive portion of the inboard/outboard engine is generally mounted to the transom in the exposed portion. However, the marine engine forms no part of the invention per se and is not shown.

Each of the portions of the rear wall 27 has an outlet port 28, 29 formed therein through which exhaust gas is emitted. The outlet ports are preferably formed just above the waterline and flapper valves are provided to prevent backflow of water through the ports.

A generally horizontal platform 30 connects the curved portions of the rear wall 27 to one another, the platform 30 being spaced below the bottom surface of the swim platform extension 18. It will be seen that the housing thus defines a pair of symmetrical side chambers 31 and 32 within the housing.

The chamber 31 receives a molded muffler insert 40 and the chamber 32 receives an oppositely shaped muffler insert 50. The inserts 40 and 50 are essentially the mirror image of one another and accordingly only the insert 40 will be described in detail, the numerals describing the insert 40 being numbers 41–49 and the numerals applied to the insert 50 correspondingly being numerals 51–59.

The muffler and swim platform assembly 17, to include the swim platform extension 18, the muffler housing 20 and the inserts 40 and 50 are preferably formed of the same material used in the hull of the power boat 10 such as fiberglass reinforced plastic, however, other suitable material may of course be used as will be apparent to those skilled in the art. Fiberglass reinforced plastic is preferred in view of its high strength and invulnerability and its non-corrosive character. The various components are preferably bonded together with epoxy or other suitable adhesive.

The insert 40 is adapted to fit snugly in the side chamber 31 with portions thereof secured to the floor. Also the insert is tightly secured at the interface with the forward wall 22 and also at the interface with the rear wall 27. As to its shape, the insert 40 comprises an irregularly contoured member formed of a layer of rigid material which is shaped to define a domed portion 41 open at the forward end. The portion 41 defines with the floor 21 of the chamber 31 and the forward wall 22, a downwardly facing muffling chamber 42.

It will be seen that exhaust gases enter the muffling chamber 42 through the exhaust pipe 15 which extends through the transom 11, through the forward wall 22 and into the muffling chamber 42. The insert 40 also has a bulged portion 43 which is adjacent the domed portion 41 and which defines with the floor 21 and the forward wall 22 of the housing and with the rear wall of the housing, an expansion chamber 44. The rearward end of the expansion chamber 44 communicates with the exhaust port 28 so that exhaust gases passing through the expansion chamber exit the muffler through the exhaust port at about the waterline.

The rearward end of the expansion chamber 44 defines a parametric edge face that registers with the inner surface of the rear wall 27 so that the insert is adhered to the rear wall in proper registration with the outlet port. The muffling chamber 42 and the expansion chamber 44 are connected to one another by a connecting passage 45 defined in part by the wall of the insert 40 and in part by the floor of the housing, all below the waterline. When the muffling chamber 42 and the expansion chamber 44 are partially filled with water the passage 45 is also filled so that exhaust gas passing into the muffling chamber 42 is forced by a gas pressure through the water in the passage 45 and into the expansion chamber 44. This effect greatly enhances the sound deadening capability of the muffler.

The unique construction and shape of the inserts 40 and 50 provide optimum exhaust gas transmission and muffling capability and afford a relatively inexpensive means for achieving the desired results.

The particular design of the muffling chamber 42 and expansion chamber 44 depends upon the exhaust pressures provided through the exhaust pipe 22, upon the desired reduction in noise level, upon the backpressures experienced within the two chambers and upon other factors well known to those skilled in the art.

Other modifications are also easily provided. For example, a muffler may be designed with a single insert for use on a motor boat only having a single exhaust pipe, in which case the rear wall would be provided with a single exhaust port. Also, other modifications may be used with twin engine power boat designs where four exhaust pipes extend through the transom so that four chambers must be provided within the housing and four separate inserts provided to achieve the desired advantages of the invention.

Figure 7:
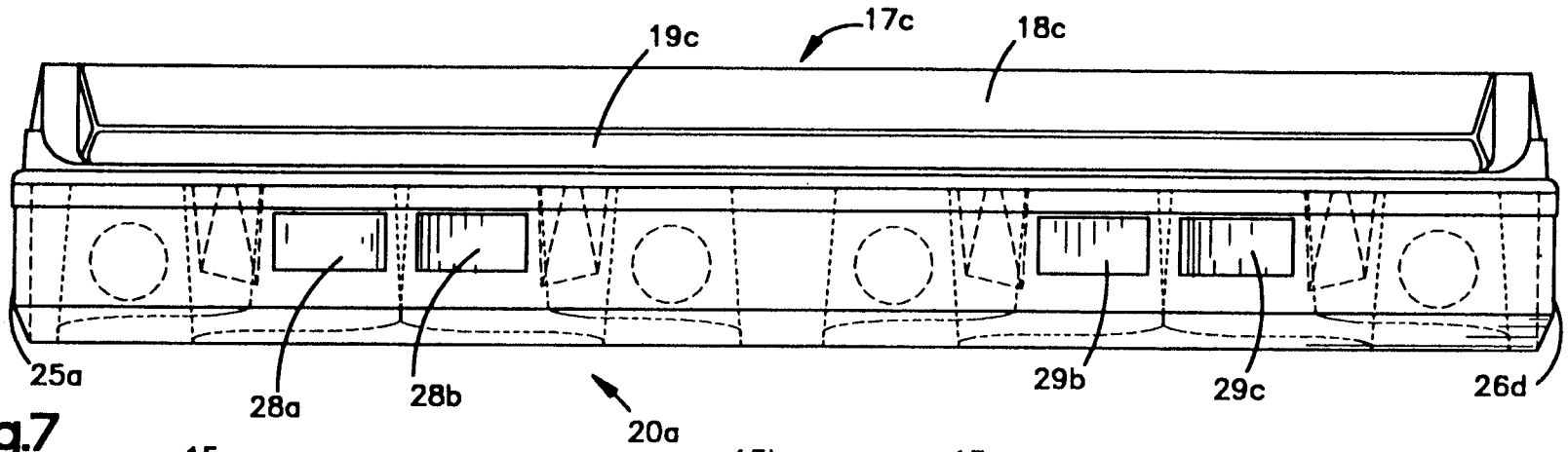
FIG. 7 is an end elevation similar to FIG. 3 but showing the stern portion of a twin engine inboard/outboard-type powerboat having a dual exhaust muffler arrangement for each engine, comprising an alternate form of the invention.
Figure 8:
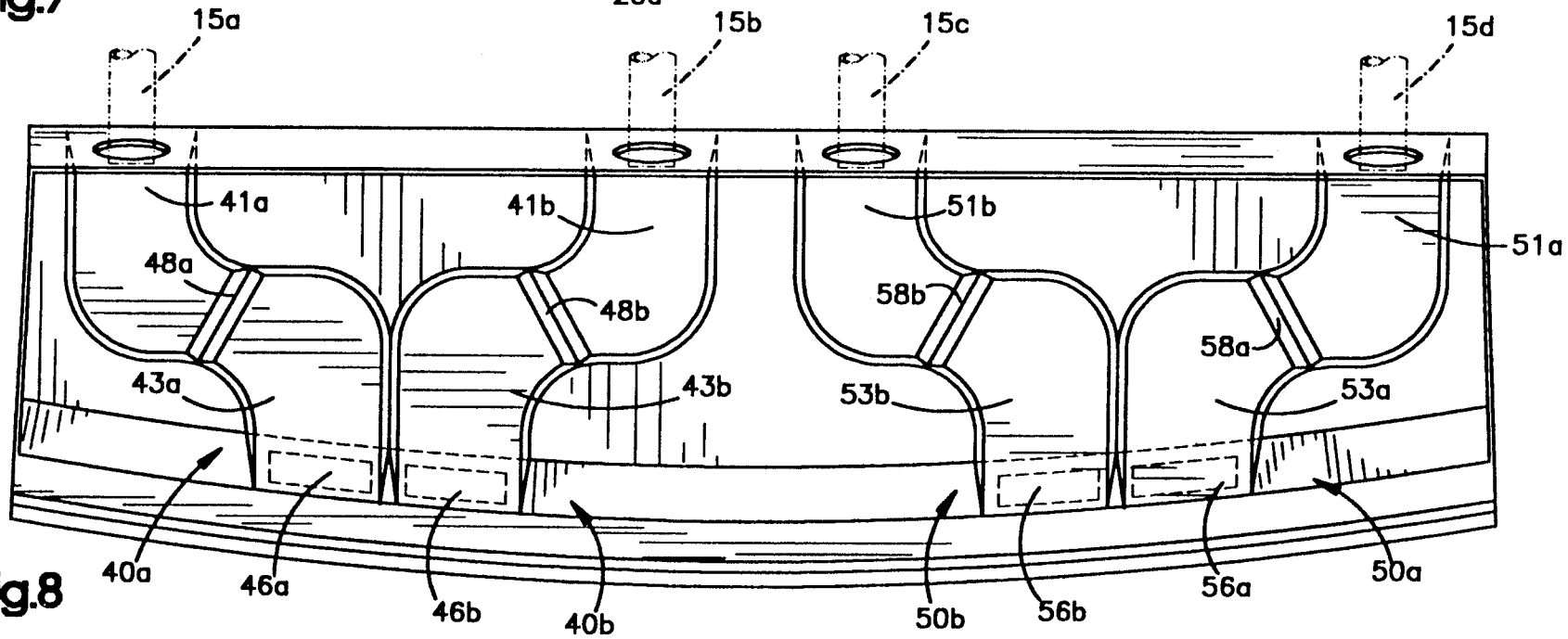
FIG. 8 is a sectional view taken on the line 8—8 of FIG. 7.

An example of the latter configuration is shown in FIGS. 7 and 8 which show a muffler and swim platform assembly **17*a* mounted at the stern of a powerboat that has four exhaust pipes 15*a*, 15*b*, 15*c* and 15*d* extending through the transom. The assembly 17*a* includes a swim platform extension 18*a* formed integrally with the hull of the boat and which provides an upwardly facing surface 19*a* similar to the surface 19**.

The assembly **17*a* also includes a muffler housing 20*a* similar to the housing 20. The forward wall 22*a* of the housing 20*a* has four openings through which the exhaust pipes 15*a*, 15*b*, 15*c* and 15*d* extend. The housing 20*a* also includes a pair of opposed end walls 25*a* and 26*a* perpendicular to the forward wall 22*a* and a contoured rear wall 27*a*. The rear wall 27*a* has four outlet ports 28*a*, 28*b*, 29*a* and 29*b* formed therein through which exhaust gas is emitted (similar to the outlet ports 28 and 29**).

The housing **20*a* defines four chambers 31*a*, 31*b*, 32*a* and 32*b* that receive molded inserts 40*a*, 40*b*, 50*a* and 50*b*. The inserts are designed to function in the same manner as described above with respect to the inserts 40 and 50 shown in FIGS. 1–6**. Accordingly, like parts are identified by like numerals followed by the letter "a" or "b".

The device of the invention also provides a swim platform which has many advantages including natural protection to swimmers from the outboard drive which is normally located beneath the swim platform.

While the invention has been shown and described with respect to particular embodiments thereof, this is for the purpose of illustration rather than limitation and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that its inconsistent with the extent to which the progress in the art has been advanced by the invention.

What is claimed is:

1. An outboard exhaust muffler for a powerboat having a transom and at least one exhaust pipe extending through the transoms and through which exhaust gas is emitted comprising:

a housing extending laterally across the boat and rearwardly from the transom to define an interior space adapted to be partially filled with water:

said housing having a floor located below the water line, opposed end walls, a front wall located adjacent the transom with at least one opening formed therein communicating with said exhaust pipe, and a rear wall having at least one exhaust port formed therein;

means secured to the top of said housing for covering said interior spaces; and at least one insert located in said interior space and secured to said floor, said front wall and said rear wall;

said insert having a domed portion that defines with said floor, an enclosed muffling chamber communicating with said exhaust pipe, a bulged portion that defines an expansion chamber communicating with said exhaust port and a passage located below the water line communicating between said chambers;

whereby exhaust gas entering said muffling chamber is forced through said water filled passage into said expansion chamber and exits said exhaust port.

2. An outboard exhaust muffler as defined in claim 1, wherein said means secured to the top of the walls of said housing is a swim platform.

3. An outboard exhaust muffler as defined in claim 1, wherein said housing is formed of molded fiber glass reinforced plastic.

4. An outboard exhaust muffler as defined in claim 3, wherein said insert is formed of molded fiber glass reinforced plastic.

5. An outboard exhaust muffler as defined in claim 1, wherein said powerboat has a single inboard engine with two exhaust pipes and wherein said housing has two inserts, one for each exhaust pipe.

6. An outboard exhaust muffler as defined in claim 1, wherein said powerboat has two inboard engines with two exhaust pipes for each engine and wherein said housing is provided with four inserts, one for each exhaust pipe.

* * * * *